United States Patent [19]

Zucker et al.

[11] Patent Number: 4,552,341

[45] Date of Patent: Nov. 12, 1985

[54] METHOD OF PROTECTING A ROADWAY MAINTENANCE AND CONSTRUCTION SITE

[76] Inventors: Stanley Zucker, 15 Mary Beth Dr., Suffern, N.Y. 10901; Fritz Schwarting, 477 Beverly Rd., Ridgewood, N.J. 07450

[21] Appl. No.: 452,151

[22] Filed: Dec. 22, 1982

[51] Int. Cl.[4] ..... E04H 17/00

[52] U.S. Cl. ..... 256/1; 256/13.1; 404/6

[58] Field of Search ..... 256/1, 13.1; 404/6, 404/72

[56] References Cited

U.S. PATENT DOCUMENTS

| | | | |
|---|---|---|---|
| 2,308,706 | 1/1943 | Mitcham | 256/1 |
| 2,560,625 | 7/1951 | Boggs, Jr. et al. . | |
| 2,759,737 | 8/1956 | Manning . | |
| 2,797,928 | 7/1957 | Blubaugh . | |
| 3,536,339 | 10/1970 | Fichtenberg . | |
| 3,606,258 | 9/1971 | Fitch | 256/13.1 |
| 4,065,104 | 12/1977 | Pass | 256/13.1 |

*Primary Examiner*—Andrew V. Kundrat
*Attorney, Agent, or Firm*—Lee C. Robinson, Jr.

[57] ABSTRACT

A method of protecting a roadway maintenance or construction site in which a crash cushion is mounted on the bed of a trailer or other unpowered wheeled vehicle. The crash cushion preferably comprises an intertial system of free standing sand-filled plastic containers or other suitable impact attenuator which in some cases is used with a backup structure. The unpowered vehicle is then connected to a powered towing vehicle and is towed to the maintenance or construction site. When the unpowered vehicle and its crash cushion are located in position to block oncoming traffic at the site, the unpowered vehicle is disconnected from the towing vehicle, to enable release of the towing vehicle for other purposes. The trailer bed of the unpowered vehicle is lowered relative to the vehicle wheels such that the bed rests on the roadway to thereby maintain the crash cushion in a fixed and favorable position relative to oncoming traffic.

11 Claims, 8 Drawing Figures

FIG. 6
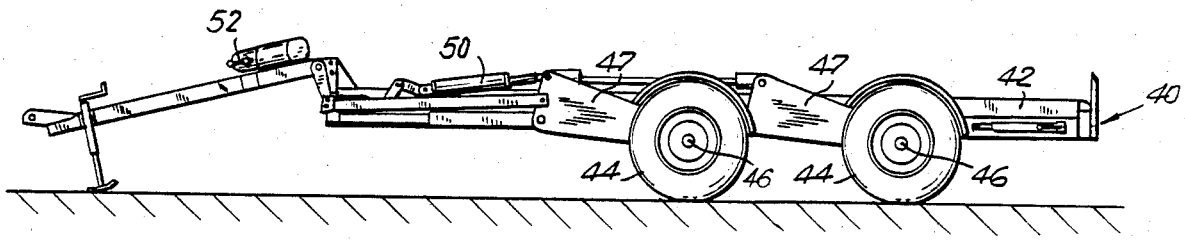
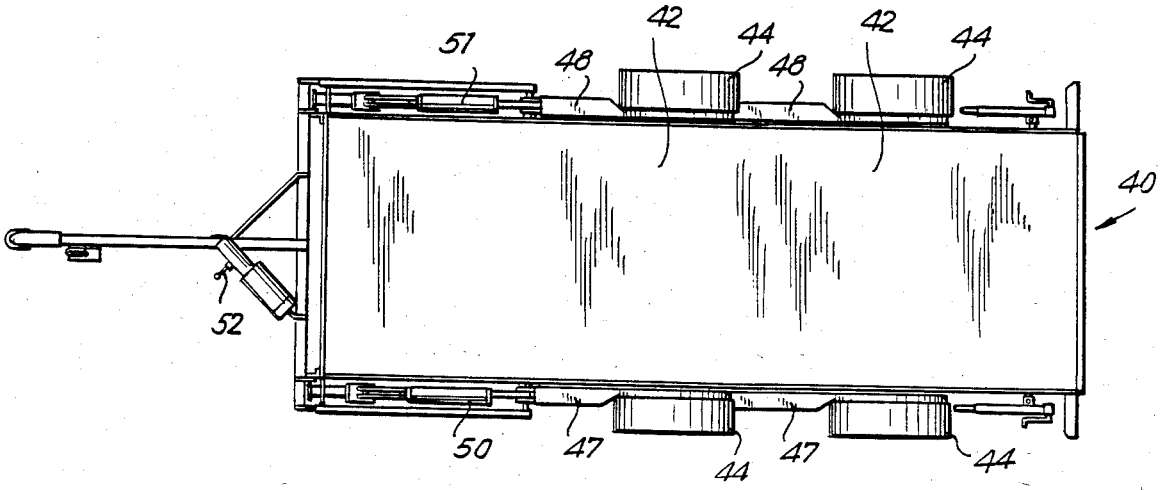
FIG. 7
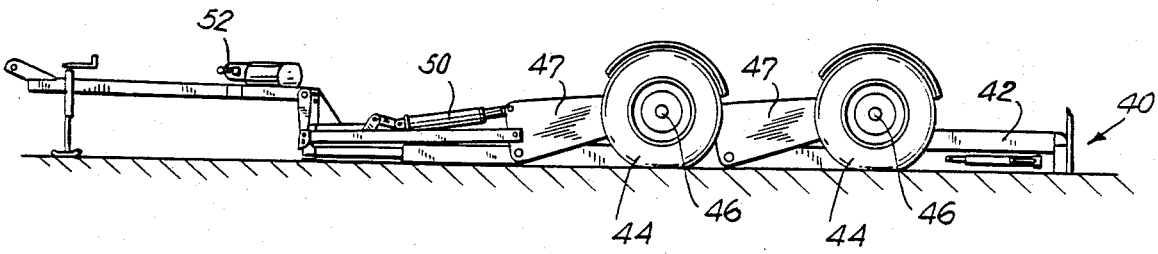
FIG. 8

METHOD OF PROTECTING A ROADWAY MAINTENANCE AND CONSTRUCTION SITE

This invention relates to a method of protecting a maintenance or construction site and more particularly to a method of protecting construction crews and equipment working in a roadway, as well as reducing accident severity for the errant vehicle and its occupants.

BACKGROUND OF THE INVENTION

At roadway maintenance and construction sites it is common practice to use conical markers, signs, flags, flashing lights, etc. to warn motorists of a traffic diversion ahead and to direct traffic away from the maintenance or construction area. In addition, particularly on high speed throughways and at other locations where there is a danger that work crews may be injured by motorists who disregard or fail to observe these warnings, temporary traffic barriers have been set up in an attempt to positively prevent an errant vehicle from reaching the maintenance and construction area. Wooden or concrete barriers have been used at long term projects, while generally at projects of short duration a heavy piece of mobile equipment such as a large truck has been positioned on the roadway between the work crew and the oncoming traffic. In some cases the truck has been equipped with a crash cushion to reduce the severity of impact to the errant vehicle, and its occupants as well as to the truck and the work crew. In some situations crash cushions are placed directly on the roadway to serve as a cushioning device.

The various traffic barriers and installation procedures employed heretofore have exhibited a number of disadvantages. In cases in which wooden barriers were used, they had a tendency to splinter on impact, and the splinters on occasion would create a hazard by piercing the vehicle and thus seriously injuring the occupants. Concrete barriers, due to their weight and size are time consuming to transport, install, remove and relocate and therefore are not practical for short duration work operations or for low speed roadway conditions. In addition, these types of positive barriers can themselves constitute a roadside hazard to errant vehicles.

The use of a heavy construction vehicle as a barrier had the disadvantage that an expensive or special purpose piece of equipment was tied up and unavailable for other purposes for the duration of the work project. In the event of an accident the equipment was vulnerable to extensive damage rendering it out of service and subject to costly repairs and/or replacements.

In situations where crash cushions were placed directly on the surface of the roadway, the transporation, installation and removal of such devices was a time consuming task. In the case of vehicle mounted crash cushions, such as; liquid filled cells, light-weight concrete cells, and synthetic foam cartridges; a strong, fixed backup and support structure, mounted to a heavy vehicle is required for these cushioning devices.

SUMMARY

One general object of this invention, therefore, is to provide a new and improved method of protecting a roadway maintenance or construction site.

More specifically, it is an object of the invention to provide such a method in which the site is protected by a unique roadway barrier which is affirmatively maintained in position and yet exhibits a cushioning effect on the errant vehicle to reduce the severity of injury to both the occupants of the vehicle and the construction crew, as well as damage to the errant vehicle.

Another object of the invention is to provide a method of the character indicated in which the roadway barrier may be moved to the construction site and located in position in a rapid and straightforward manner.

Another object of the invention is to provide a method of protecting a roadway maintenance or construction site which does not tie up expensive and special purpose maintenance or construction equipment or subject such equipment to damage in the event of an accident.

Still another object of the invention is to provide a novel traffic barrier system utilizing comparatively inexpensive expendible components.

In an illustrative embodiment of the invention, the roadway maintenance or construction site is protected by towing a crash cushion to the site and positioning the cushion between the work crew and the oncoming traffic. The crash cushion is mounted on the bed of an unpowered wheeled vehicle which advantageously comprises a relatively inexpensive flat-bed trailer of a type readily expendible in the event of an accident.

In accordance with one feature of the invention, the unpowered wheeled vehicle is located in a position to block the oncoming traffic at a maintenance of construction site and is then disconnected from the towing vehicle. The towing vehicle is then released and is readily available for other uses during the work operations.

In accordance with another feature of the invention, in several particularly advantageous embodiments, when the unpowered vehicle is located in its proper blocking position the trailer bed of the vehicle is lowered relative to the wheels such that the bed rests on the roadway. With this arrangement, the unpowered vehicle and the crash cushion supported thereby are maintained in a fixed and favorable position relative to the oncoming traffic.

In accordance with a further feature of some embodiments of the invention, free standing frangible containers filled with an expendable mass are mounted on the unpowered vehicle to form an inertial crash cushion. The containers can be plastic and filled with sand in varying amounts to provide gradually increasing resistance to the impact of the errant vehicle. The inertial barrier slows an impacting vehicle by the transfer of momentum to the mass of the crash cushion and is preferred since it functions as a free standing, independent unit. However, other types of crash cushions can be utilized with appropriate provisions for any necessary backup devices to resist impact forces. The arrangement is such that the work crew and equipment are protected from errant vehicles while at the same time reducing the accident severity to the errant vehicle and its occupants.

The present invention, as well as further objects and features thereof, will be more fully understood from the following description of a preferred embodiment, when read with reference to the accompanying drawings.

BRIEF DESCRIPTION OF THE DRAWINGS

FIG. 6 is a side elevational view of another type of unpowered wheeled vehicle useful in carrying out the method of the invention.

FIG. 7 is a top plan view of the vehicle shown in FIG. 6.

FIG. 8 is a side elevational view similar to FIG. 6 but showing the vehicle in its blocking position.

DESCRIPTION OF A PREFERRED EMBODIMENT

Figure 1:
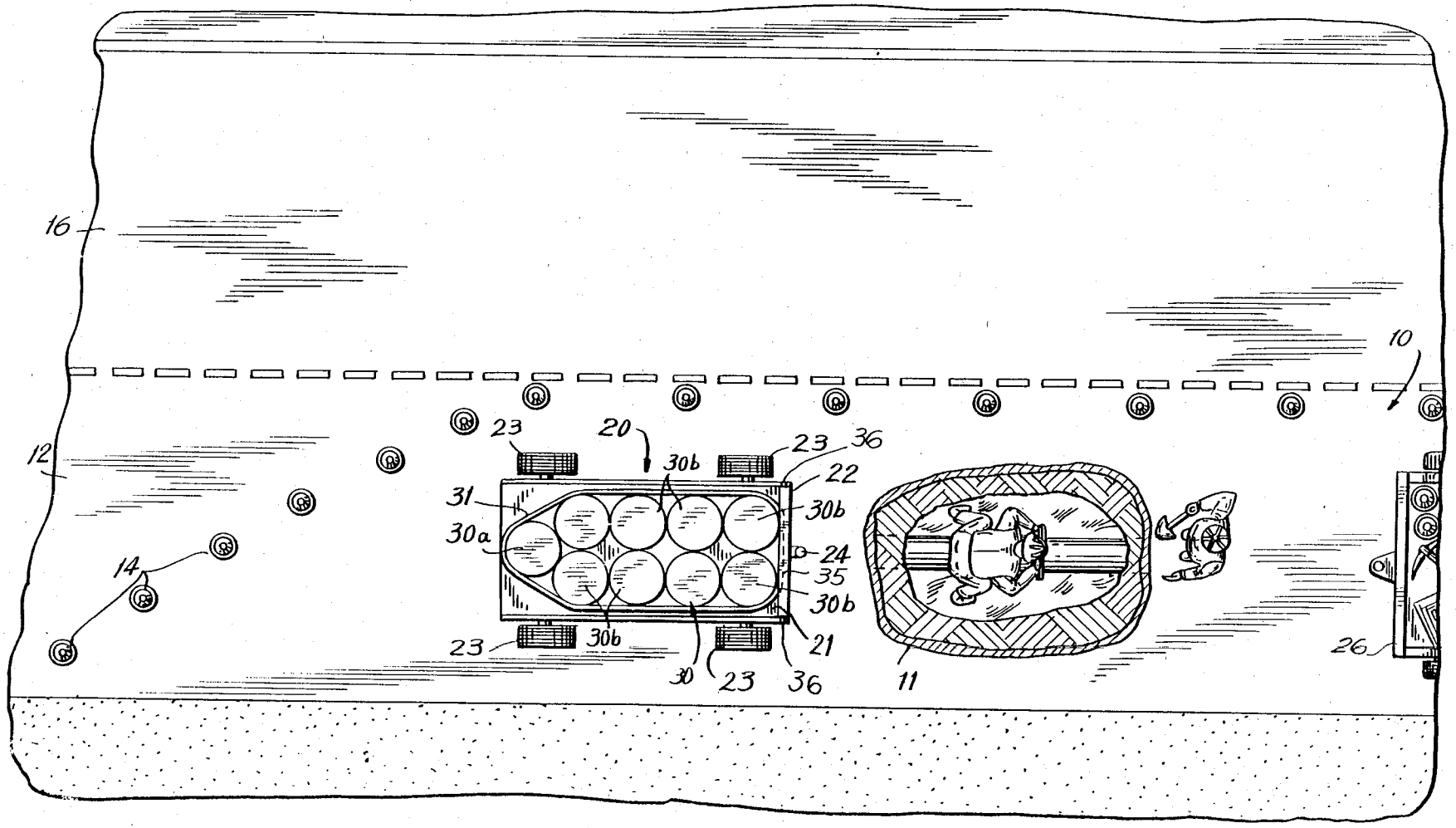
FIG. 1 is a top view of a roadway maintenance or construction site protected in accordance with an illustrative embodiment of the invention.

Referring to FIG. 1 of the drawings, there is shown a roadway maintenance site indicated generally at 10. The site 10 includes a work area 11 in one of the lanes 12 of the roadway and a series of warning devices in the form of conical markers 14 to direct oncoming traffic away from the site and into the adjacent lane 16. Various signs, flags, flashing lights and other warming devices (not shown) also are commonly employed to alert motorists that the roadway is under maintenance or construction.

Located at the maintenance site 10 in position to block oncoming traffic is a crash cushion 20. The cushion 20, which will be described in more detail hereinafter, is mounted on the bed 21 of an unpowered wheeled vehicle 22. The vehicle 22 is of conventional construction and is in the form of a four-wheel flat-bed trailer having wheels 23. The bed 21 of the vehicle is vertically movable relative to the wheels 23. A suitable hitch 24 is employed for towing the vehicle from one location to another. The vehicle 22 is located between the maintenance crew at the work area 11 and the oncoming traffic and is longitudinally oriented with respect to the traffic such that the axles of the wheels 23 extend transversely to the lanes 12 and 16.

The unpowered vehicle 22 with the crash cushion 20 mounted theron is towed to the construction site 10 by a powered towing vehicle 26. The vehicle 26 may be a truck or other piece of equipment that is capable of towing the trailer and the crash crushion mounted thereon. The unpowered vehicle 22 is releasably connected to the towing vehicle 26 through the use of the hitch 24. When the vehicles 22 and 26 reach the site and the vehicle 22 with its crash cushion 20 are located in the blocking position illustrated in FIG. 1, the vehicles are disconnected, and the towing vehicle 26 is moved to a remote location where it is available for other purposes.

Figure 4:
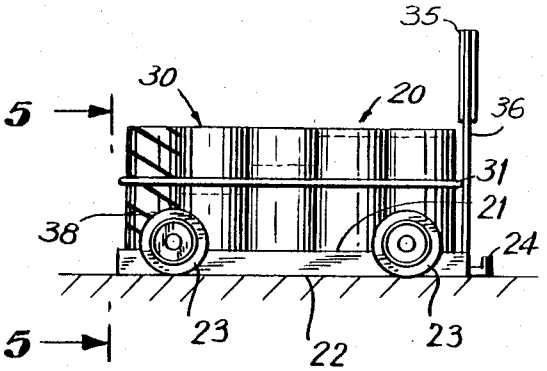
FIG. 4 is a side elevational view of the vehicle and crash cushion after it has been located in a blocking position on the roadway.
Figure 5:
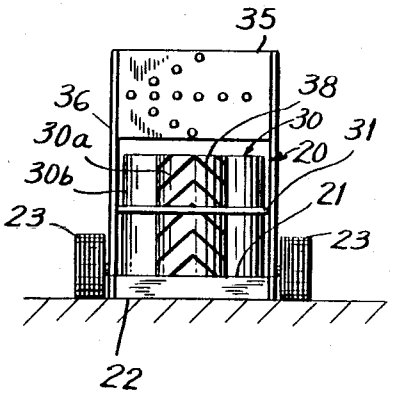
FIG. 5 is an end elevational view of the vehicle and crash cushion as seen from the line 5—5 in FIG. 4.
Figure 2:
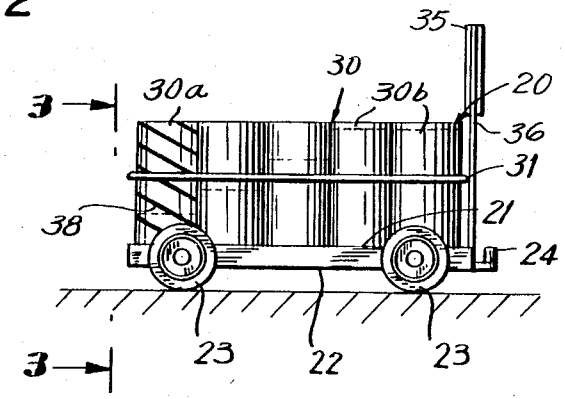
FIG. 2 is a side elevational view of an unpowered wheeled vehicle and crash cushion for protecting the maintenance or construction site.
Figure 3:
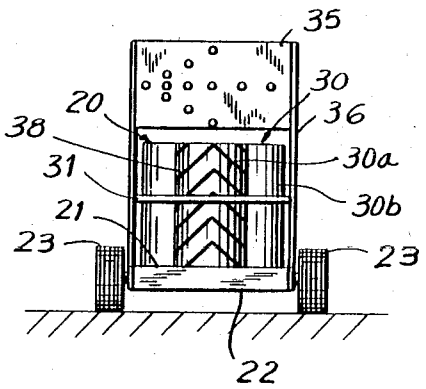
FIG. 3 is an end elevational view of the vehicle and crash cushion as seen from the line 3—3 in FIG. 2.

After the vehicles have been disconnected at the maintenance site, the flat bed 21 of the unpowered vehicle 22 is lowered relative to the wheels 23 of the vehicle in the manner shown in FIGS. 4 and 5. The thus lowered bed 21 rests on the roadway to thereby maintain the crash cushion 20 in a fixed position relative to oncoming traffic. In this position the crash cushion provides positive protection from the oncoming traffic for the construction crew at the site.

Various forms of crash cushions may be mounted on the bed 21 of the powered vehicle 22 in accordance with the invention. In the illustrated embodiment the crash cushion 20 advantageously comprises a series of frangible containers 30 which are filled with graduated amounts of an expendable and dispersible mass such as sand. The containers 30 are arrayed in two rows of four containers each with an additional container on the leading side of the crash cushion facing the oncoming traffic. A band 31 extends around the assembly of containers 30 to hold them in position. The containers 30 are made of polyethylene or other material designed to shatter upon impact in order to permit maximum dispersion of the sand or other mass contained therein. The leading container **30*a* closest to the oncoming traffic as well as the adjacent pair of containers contain sand up to about only one-fifth of their capacity, and the succeeding containers contain progressively greater quantities of sand such that the rearmost pair of containers 30*b* are substantially completely full. In one illustrative arrangement the weight of the filled containers 30*a*** is four hundred pounds, the weight of each of the filled barrels in the next succeeding pair is four hundred pounds, the weight of the filled barrels in the next succeeding pair is seven hundred pounds, the weight of each of the substantially filled barrels in the next succeeding pair is fourteen hundred pounds, and the weight of each of the filled barrels in the remaining pair is twenty-one hundred pounds. The center of mass of the assembled barrels is at an elevation corresponding to the approximate center of gravity of the oncoming passenger car vehicles.

When an errant vehicle strikes the crash cushion 20, the vehicle shatters the sand-containers 30. The momentum of the vehicle is transferred to the sand to stop or substantially slow the vehicle in advance of the work crews while reducing the severity of injury to its occupants and damage to the vehicle. As the impacting vehicle contacts the first few containers 30, its velocity is reduced in successive increments through inertial action, and the vehicle then begins to plow through the sand from these and the remaining containers to provide acceptable deceleration.

In certain embodiments of the invention the inertial crash cushion containers 30 can be replaced by various different types of energy absorbing systems. In some cases the crash cushion is in the form of liquid filled cells (not shown) mounted on the bed 21 of the unpowered vehicle 22, while in other arrangements the crash cushion comprises a block of compressible synthetic foam material. In still other embodiments readily frangible vermiculite concrete, heavy metal drums, pipes and similar cushions may be employed. In several of these latter embodiments a fixed block of concrete or other rigid structure is located along the rearward portion of the bed 21 to provide the necessary backup to resist impact forces.

In the embodiment illustrated in FIGS. 1–5 the unpowered vehicle 22 includes a warning device 35 which is mounted on a suitable frame structure 36 affixed to the bed 21. The warning device 35 is in the form of a sign depicting an arrowhead to direct traffic away from the construction site. In addition, diagonal stripes 38 are provided on the plastic container **30*a* to similarly alert motorists that the roadway is under maintenance or construction. The stripes 38** form an inverted "V" to provide a chevron design.

Referring now to FIGS. 6–8 there is shown another form of unpowered wheeled vehicle that may be employed to support the crash cushion at the construction site. The vehicle of these figures comprises a tandem axle trailer 40 having wheels 44 and a flat bed 42 which may be lowered relative to the wheels from the position shown in FIG. 6 to that shown in FIG. 8. The axles 46 for the wheels 44 are supported by plates 47 and 48 which are respectively connected to hydraulic cylinders 50 and 51. These cylinders are actuated under the control of a lever 52 or by means of a push button (not shown) adjacent to the forward portion of the trailer bed 42 to pivot the plates and thereby raise or lower the axles 46.

A suitable crash cushion is mounted on the bed 42 of the trailer 40 in the manner described heretofore, and the trailer is then towed to the roadway maintenance or construction site by a powered vehicle such as the truck 26 (FIG. 1). After the trailer 40 has been located in position to block oncoming traffic at the site, it is disconnected from the towing vehicle, and the towing vehicle is released for other purposes. The control lever 52 or push button is actuated to lower the trailer bed 42 relative to the wheels 44 such that the bed rests on the roadway and thereby maintains the crash cushion in a fixed and favorable position relative to oncoming traffic. For the particular trailer illustrated in FIGS. 6–8 the uppermost portion of the bed 42 is approximately four inches above the surface of the roadway when it is lowered relative to the wheels 44.

The crash cushions and trailers or other unpowered vehicles used with the invention may be positioned at various locations at a given maintenance or construction site depending upon traffic conditions at the site. In some cases, particularly during construction projects on high speed throughways or to provide the construction crews with even further protection from oncoming vehicles two or more of the crash cushions and their supporting unpowered vehicles can be located at the site. For this additional protection, the crash cushions and vehicles are positioned one behind the other.

The terms and expressions which have been employed are used as terms of description and not of limitation, and there is no intention, in the use of such terms and expressions, of excluding an equivalents of the features shown and described or portions thereof, it being recognized that various modifications are possible within the scope of the invention claimed.

What is claimed is:

1. A method of protecting a roadway maintenance or construction site, comprising, in combination:

mounting a crash cushion on the bed of an unpowered wheeled vehicle, the bed of the unpowered vehicle being vertically movable relative to the wheels;

releasably connecting the unpowered vehicle to a powered towing vehicle;

towing the unpowered vehicle to the site and locating the same in position to block oncoming traffic at said site;

disconnecting the unpowered vehicle in said blocking position from the towing vehicle, to enable the movement of the towing vehicle to a remote location; and lowering the bed of the unpowered vehicle relative to the wheels until the lowermost portion of the vehicle rests on the surface of the roadway with the bed lying on said roadway, thereby maintaining the crash cushion in a fixed and favorable position to protect the maintenance or construction crew as well as the occupants of any vehicle coming in contact with the crash cushion.

2. A method of protecting a roadway maintenance or construction site as defined in claim 1, in which the crash cushion comprises an inertial system including free standing frangible containers and an expendable easily dispersed mass within said containers for absorbing momentum transferred by an impacting errant vehicle, and wherein the containers are mounted on the unpowered vehicle and the unpowered vehicle is then towed to said site.

3. A method of protecting a roadway maintenance or construction site, comprising, in combination:

mounting a plurality of containers on the bed of an unpowered wheel vehicle to form a crash cushion, the bed of the unpowered vehicle being vertically movable relative to the wheels;

filling said containers with cushioning material;

releasably connecting the unpowered vehicle to a powered towing vehicle;

towing the unpowered vehicle to the site and locating the same in position to block oncoming traffic at said site;

disconnecting the unpowered vehicle in said blocking position from the towing vehicle, to enable the movement of the towing vehicle to a remote location; and lowering the bed of the unpowered vehicle relative to the wheels until the lowermost portion of the vehicle rests on the surface of the roadway with the bed lying on said roadway, thereby maintaining the crash cushion in a fixed and favorable position to protect the maintenance or construction crew as well as the occupants of any vehicle coming in contact with the crash cushion.

4. A method of protecting a roadway maintenance or construction site as defined in claim 3, in which successive containers are filled with different quantities of cushioning material to provide increasing resistance to the movement of an errant vehicle contacting said crash cushion.

5. A method of protecting a roadway maintenance or construction site, comprising, in combination:

mounting a crash cushion on the bed of an unpowered wheeled vehicle, the bed of the unpowered vehicle being vertically movable relative to the wheels;

releasably connecting the unpowered vehicle to a powered towing vehicle;

towing the unpowered vehicle and the crash cushion thereon to the site and locating the same in position to block oncoming traffic at said site;

disconnecting the unpowered vehicle in said blocking position from the towing vehicle, to enable the movement of the towing vehicle to a remote location; and lowering the bed of the unpowered vehicle relative to the wheels such that the lowermost portion of the vehicle rests on the surface of the roadway with the bed lying on said roadway and thereby maintains said crash cushion in a fixed position to protect the maintenance or construction crew as well as the occupants of any vehicle coming in contact with the crash cushion.

6. A method of protecting a roadway maintenance or construction site as defined in claim 5, in which the crash cushion comprises an inertial system including free standing sand-filled plastic containers, and wherein successive containers are filled with graduated quantities of sand to provide increasing resistance to the movement of an errant vehicle contacting said crash cushion.

7. A method of protecting a roadway maintenance or construction site as defined in claim 6, in which pairs of said containers are mounted on the bed of the unpowered vehicle in a plurality of rows.

8. A method of protecting a roadway maintenance or construction site as defined in claim 6, in which at least one of the containers closest to the oncoming traffic is filled with a smaller quantity of sand than at least one of the remaining containers.

9. A method of protecting a roadway maintenance construction site, in combination:

mounting a plurality of containers on the bed of an unpowered wheeled vehicle to form a crash cushion, the bed of the unpowered vehicle being vertically movable relative to the wheels;

filling said containers with cushioning material;

releasably connecting the unpowered vehicle to a powered towing vehicle;

towing the unpowered vehicle and the crash cushion thereon to the site and locating the same in position to block oncoming traffic at said site;

disconnecting the unpowered vehicle in said blocking position from the towing vehcle, to enable the movement of the towing vehicle to a remote location; and lowering the bed of the unpowered vehicle relative to the vehicle wheels such that the lowermost portion of the vehicle rests on the surface of the roadway with the bed lying on said roadway and thereby maintains said crash cushions in a fixed position to protect the maintenance or construction crew as well as the occupants of any vehicle coming in contact with the crash cushion.

10. A method of protecting a roadway maintenance or construction site as defined in claim 9, in which successive containers are filled with different quantities of cushioning material.

11. A method of protecting a roadway maintenance or construction site as defined in claim 9, which further comprises providing a warning device on said unpowered vehicle in position to be visible by the oncoming traffic.

* * * * *